United States Patent [19]

Kincaid et al.

[11] Patent Number: 4,565,080

[45] Date of Patent: Jan. 21, 1986

[54] LATCH WITH REMOVABLE LOCK

[75] Inventors: Herbert Kincaid, Libertyville; Michael L. Wray, Hanover Park, both of Ill.

[73] Assignee: The Eastern Company, Naugatuck, Conn.

[21] Appl. No.: 557,850

[22] Filed: Dec. 5, 1983

[51] Int. Cl.[4] ..... E05B 13/10

[52] U.S. Cl. ..... 70/215; 70/224; 70/360; 70/361; 70/370; 70/371

[58] Field of Search ..... 70/224, 215, 370, 371, 70/360, 208, 216, 361, 217

[56] References Cited

U.S. PATENT DOCUMENTS 1,539,446 5/1925 Vincent ..... 70/215

1,853,162 4/1932 Jacobi ..... 70/371 X

*Primary Examiner*—Robert L. Wolfe

*Assistant Examiner*—Lloyd A. Gall

*Attorney, Agent, or Firm*—Wood, Dalton, Phillips, Mason & Rowe

[57] ABSTRACT

An improved door latch of the type having a handle movable to latch and unlatch the door. A lock is disposed in the handle and is movable to a locked position wherein the lock extends from the handle to engage the door preventing movement of the handle. A bolt extends from the side of the lock to maintain the lock in the locked position, the bolt being retracted by insertion and rotation of a key in the lock. The lock is also movable to an unlocked position wherein the lock is withdrawn from the door to permit movement of the handle. The improvement concerns a chamber having a partition which defines a first pocket to receive the extended bolt and maintain the lock in the locked position. The partition also defines a second pocket to receive the extended bolt when the lock is in the unlocked position. To move the lock between the unlocked and locked position the key must be inserted to retract the bolt clear of the partition. This prevents the inadvertent locking of the door in the closed position without the key.

5 Claims, 6 Drawing Figures

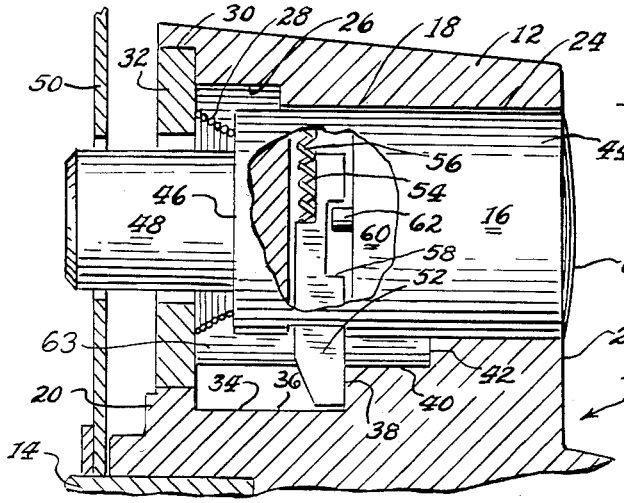
Fig.1.
PRIOR ART
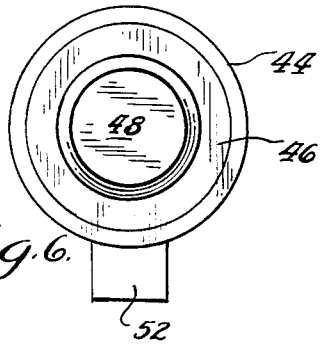
Fig.6.
Fig.2.
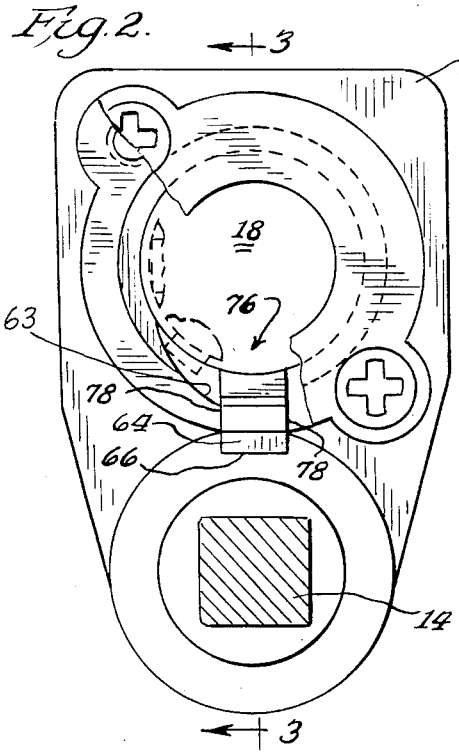
Fig.3.
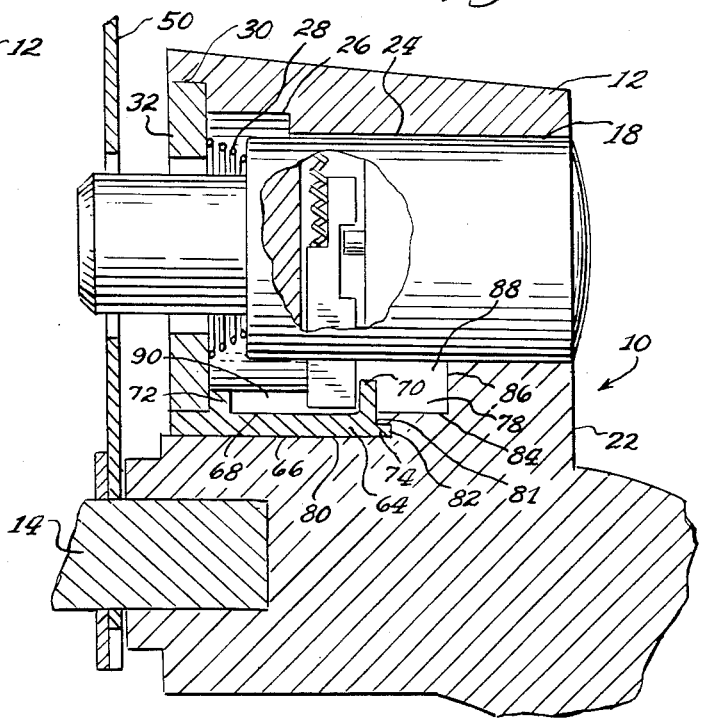
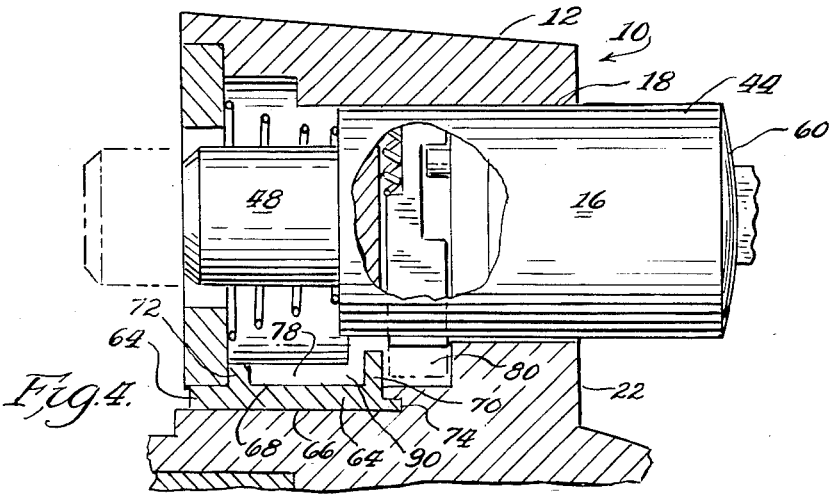
Fig.4.
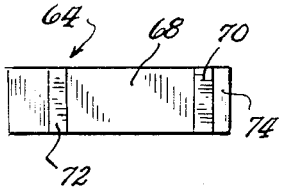
Fig.5.

LATCH WITH REMOVABLE LOCK

BACKGROUND OF THE INVENTION

1. Field of the Invention

This invention relates to a latch and more particularly a door latch of the type having a fixed mounting on a door and a latch operating handle carrying a lock whereby the handle may be locked to the mounting when the door is latched.

2. Description of the Prior Art

Vehicles such as vans, trucks or the like are provided with a door which permits entrance into the vehicle or restricted portion thereof. A handle located on the outside of the vehicle moves to operate a latch mechanism within or behind the door to latch the door closed or unlatch it for opening. To lock the latch mechanism, typically a key-operated lock within the door is locked to prevent the latch mechanism from being operated by the handle. Alternatively, a lock may be provided in the handle to lock the handle to the door when latched closed. Anyone desiring to open the door must have the proper key and must first unlock the lock and thereafter operate the handle to unlatch the door.

A drawback heretofore observed in the use of these latch-lock systems is that of changing the lock. It is sometimes desirable to be able to change the lock and thereby assure the security of the interior of the vehicle should the key to the lock fall into the wrong hands. Accordingly, U.S. Pat. No. 4,380,915 entitled "A Latch Having a Removable Lock" and assigned to the assignee of this application sets forth a means whereby the lock can easily be changed.

However, it has been found that latches of the type having a removable lock can lock the door closed without the presence of the key to the lock. Often locking is accomplished merely by pushing the lock to its locked position either with or without the key being inserted into the lock. This sometimes leads to the perplexing problem wherein the key is inadvertently left within the vehicle, the door is closed and latched and the lock is pushed to its locked position. In turn, this leads to the inability to re-open the door since the keys are locked inside or, if the ignition key to the vehicle is on the same keychain, the inability to drive the vehicle. Heretofore the only solution suggested was to provide a set of identical keys to be produced when the keys in the possession of the driver are locked within a vehicle. This necessitates, for fleets of vehicles, the maintenance of a large inventory of alternate keys and the problem of how to deliver the alternate keys to the driver for opening of the door.

It is an object of this invention to set forth a latch having a removable lock which cannot be locked without the use of the key.

SUMMARY OF THE INVENTION

Accordingly, a latch handle is set forth having a removable lock which cannot lock the handle without the use of the key. This in turn prevents inadvertent locking of the key within the vehicle.

Toward this end a latch is provided of the type having a handle which is movable to latch and unlatch the latching mechanism. Disposed within a handle is a lock which can move axially and rotate relative to the handle. To lock the handle and the latch mechanism, the lock is axially displaced to a locked position wherein a finger on the end of the lock extends from the handle to engage the door preventing movement of the handle for unlatching of the latch mechanism. A bolt is biased from the lock to extend from a side thereof and engage structure in a channel within the handle to maintain the lock in the locked position.

To unlock the lock for movement of the handle and unlatching of the latch mechanism, the key is inserted into the lock and rotated which in turn retracts the bolt permitting the lock to move axially and retract the finger from the door. When the lock has been retracted to an unlocked position the key is reversely rotated extending the bolt into the pocket disposed in the handle. Thereafter the key can be withdrawn from the lock, the lock being held in the unlocked position by the reception of the bolt into the pocket.

To prevent the lock from being axially moved to a locked position without the insertion and rotation of the key, a partition is disposed in the channel. The partition is engaged by the extended bolt to prevent movement of the lock to the locked position.

To lock the handle and the latch mechanism, the key is inserted in the lock and rotated to retract the bolt freeing the lock for axial movement. The lock is moved against the bias of the spring to the locked position, the key is reversely rotated and withdrawn whereby the bolt extends and is received into the locked portion of the channel.

To remove the lock from the handle a circumferential cam surface is provided within the handle and is engaged by the bolt when in the retracted position. To remove the lock the key is inserted and the bolt is retracted and the lock is axially positioned to align the bolt with the cam surface. Thereafter, the barrel of the lock is rotated causing the bolt to follow the cam surface and become completely withdrawn into the barrel whereupon the lock pops from the handle due to the bias exerted by the spring.

It is therefore an object of this application to set forth an improved latch having a removable lock wherein the latch cannot be locked without insertion of the proper key into the lock which resides in the latch handle.

Further objects and advantages will become apparent from a study of the following portions of the specification, the claims and the attached drawings.

BRIEF DESCRIPTION OF THE DRAWINGS

FIG. 1 is a partial sectional view of a prior art latch handle having a removable lock;

FIG. 2 is an end view of a portion of the handle of the latch of the present invention;

FIG. 3 is a partial sectional view of the improved latch of the present invention in the locked position;

FIG. 4 is a partial sectional view of the latch of the present invention illustrating the lock in the unlocked position;

FIG. 5 is a top view of the insert disposed in the latch handle to prevent locking of the handle without a key; and FIG. 6 is an end view of the lock of the handle of the present invention.

DESCRIPTION

Turning to the drawings, FIG. 1 illustrates a prior art latch with a removable lock. Typically the latch mechanism (not shown) is disposed within or behind the door of the vehicle, the latch mechanism being operated for freeing the door for opening thereof or for latching the door in a closed position. To operate the latch mechanism an external handle 10 is provided having a handgripping portion (not shown) and a head portion 12. The handle 10 is operatively connected to the latch mechanism through a rectangular shaft 14 which supports the handle and extends into the door for connection to the latch mechanism. Rotation of the handle 10 rotates its shaft 14 to, in turn, operate the latch mechanism for latching and unlatching of the door.

To receive a key operated lock 16, the head portion 12 of the handle 10 has a lock receptacle 18 extending between a forward face 20 and rear face 22 thereof. The lock receptacle 18 consists, in part, of three coaxial bores, the axes of which are orthogonal to the front and rear faces 20 and 22. The first of these bores is a lock receiving bore 24 which closely receives and guides the movement of the lock 16, the lock receiving bore 24 extending into the rear face to a depth representing approximately $\frac{2}{3}$ the span between the front and rear faces 20 and 22. The second coaxial bore is a bias receiving bore 26 which is of a larger diameter than and extends from the lock receiving bore 24 to have a terminus near the forward face 20. The bias receiving bore 26 houses a coil spring 28, the purposes of which will hereinafter become evident. The third of the coaxial bores is a face plate receiving bore 30 which is of a larger diameter than and extends from the bias receiving bore 26 through the forward face 20. The face plate receiving bore 30 receives and mounts a face plate 32 which permits access into the lock receptacle 18 for mounting of the coil spring 28 therein.

Within the lock receptacle 18 is a stepped trough 34. The trough 34 has a lower tread 36 extending the length of the bias receiving bore 26 and into the lock receiving bore 24 terminating at a first riser 38. An upper tread 40 extends from the top of the first riser 38 to terminate at a second riser 42 located intermediate of and extending radially inward to intersect the lock receiving bore 24.

Disposed within the lock receptacle 18 is the removable lock 16. The lock 16 has a cylindrical barrel 44 which is closely received into and is rotatably supported by the lock receiving bore 24. The barrel 44 has an open end opposed by a closed end 46 having extending coaxially therefrom a cylindrical finger 48 adapted to engage an escutcheon 50 mounted on the door to lock the handle thereto.

Extending through the wall of the barrel 44 in the closed end thereof is a radially extendable bolt 52. The bolt 52 has a length such that it may be completely retracted into the barrel 44 and is adapted to be received into the trough 34. The end of the bolt 52 disposed within the barrel 44 has a spring receiving notch 54 which, in cooperation with the closed end and the wall of the barrel 44, houses a bolt spring 56 which biases the bolt 52 for extension thereof. Medially located in the bolt is a rectangular pin notch 58, the purposes of which will hereinafter become evident.

Received into the open end of the barrel 44 for rotation therein is a key operated tumbler mechanism 60. The tumbler mechanism 60 has at one end a keyway (not shown) and at the other end an eccentrically mounted lock pin 62. The lock pin 62 is received into the bolt pin notch 58 whereby insertion of the key through the keyway frees the tumbler mechanism 60 for rotation to an unlocked position which retracts the bolt 52 against the bias of the bolt spring 56. Reverse rotation of the key to the locked position displaces the lock pin 62 permitting the bolt spring 56 to urge the extension of the bolt 52.

Viewing FIG. 1 the lock 16 is shown disposed within the lock receptacle 18 in a locked position. Due to the bias of the bolt spring 56, the bolt 52 is held in engagement with the lock pin 62 and the bolt 52 is fully extended. Furthermore, in the locked position, the bolt 52 is extended into the trough 34 so that its end is disposed near the lower tread 36 thereof. The coil spring 28 supported between the closed end 46 of the barrel 44 and the face plate 32 urges the lock 16 to a position wherein the bolt 52 rests against the first riser 38. In this position the finger 48 is extended from the handle 10 and is received by the escutcheon 50 mounted to the door to prevent rotation of the handle 10 for unlatching of the door.

To unlock the handle 10 for unlatching of the latch mechanism and opening of the door, the key is inserted into the keyway freeing the tumbler mechanism 60 for rotation. Rotation of the tumbler mechanism 60 retracts the bolt 52 from first riser 38 whereupon the coil spring 28 urges the lock 16 rearwardly (to the right as shown in FIG. 1) to a position wherein the retracted bolt 52 engages the second riser 42. In this position the finger 48 is withdrawn from the escutcheon 50 and the handle 10 is free to rotate and unlatch the door.

To lock the handle 10 and the latch mechanism, the key is rotated to the lock position and removed from the tumbler mechanism 60 while the lock 16 remains in the unlocked position. The lock 16 is pushed forwardly (to the left as shown in FIG. 1) into the handle 10 causing the finger 48 to engage the escutcheon 50 and the bolt 52 to slide along the upper tread 40 and, upon clearing the first riser 38, extend downward toward the lower tread 36 due to the bolt spring 56. To accommodate the sliding of the bolt 52, its forward end is beveled.

As set forth above, the handle 10 may be locked without the insertion of the key merely by pushing the lock 16 inward into the handle 10. Accordingly, should the key be removed from the lock while in the unlocked position and be left inside the vehicle, the door may be closed, latched and locked preventing subsequent unlocking and unlatching of the door.

To provide a means for removing the lock 16 from the handle 10 for insertion of a replacement lock, the lock receptacle 18 is provided with a cam surface 63 extending from the trough 34 along the wall of the lock receptacle 18 in a helical fashion to eventually intersect the lock receiving bore 24. To retract the bolt 52 for removal of the lock 16 from the lock receptacle 18, the key is inserted into the tumbler mechanism which is rotated to retract the bolt 52 to an unlocked position. The lock 16 is then axially displaced forwardly (to the left as seen in FIG. 1) to align the retracted bolt 52 with the cam surface 63. Thereafter the barrel 44 is rotated within the lock receptacle 18 causing the bolt 52 to engage and follow the cam surface 63 to become fully retracted within the barrel 44 freeing the lock 16 for removal from the lock receptacle 18. It is to be noted that the bolt pin notch 58 is of a size to accommodate the complete retraction of the bolt 52 without interference.

Turning to FIGS. 2–6, the improved latch of the present invention is shown in detail. Like reference numerals refer to like parts.

To prevent the lock 16 from being displaced to the locked position without insertion of the key and rotation of the tumbler mechanism 60, the improved latch and lock of this application includes an insert 64 shown in FIGS. 2–5. The insert 64 is flat and generally rectangular having a planar bottom surface 66 and a parallel top surface 68. Disposed near one end of the insert 64 is an upstanding partition 70 opposed by an upstanding shoulder 72 disposed near the other end of the insert 64, the purposes of which will hereinafter become evident. To provide a means to secure the insert 64 within the lock receptacle 18, a narrow tongue 74 projects from the end of the insert 64 near the partition 70.

To receive the insert 64, the lock receptacle 18 has a channel 76 projecting into the handle head portion 12 from the wall of the lock receptacle 18. The channel 76 has parallel walls 78 spaced so as to closely receive the partition 70 therebetween. Spanning the walls 78, the channel 76 has a planar lower shelf or step 80 which extends from the forward face 20 past the bias receiving bore 26 and into the lock receiving bore 24, the lower shelf 80 having a terminus at an upstanding first wall or shoulder 81. A groove 82 is disposed in the first wall 81 and is adapted to receive the tongue 74 such that the remaining portion of the first wall 81 lies contiguous to the partition 70. The remainder of the channel 76 includes an upper shelf or step 84 extending from the first wall 81, the upper shelf 84 terminating at an upstanding second wall 86 which intersects the lock receiving bore 24 approximately intermediate thereof.

To secure the insert 64 within the lock receptacle 18, the insert 64 is positioned within the channel 76 such that the tongue 74 is received into the groove 82 as substantially shown in FIGS. 3 and 4. In this position the face plate 32 is located and secured in the face plate receiving bore 30, the face plate 32 bearing against both the top surface 68 and the shoulder 72 of the insert 64 to trap the insert 64 within the channel 76.

As observed in FIGS. 3 and 4 when the insert 64 is positioned within the channel 76 the insert top surface 68 is substantially coplanar with the upper shelf 84. Furthermore, the partition 70 has, in effect, divided the channel 76 into a rear pocket 88 and a forward pocket 90.

It is to be noted that the modifications to the lock receptacle of the prior art latch described above to accommodate the reception of the insert 64 is relatively straightforward requiring only additional machining to the trough to create the channel 76 set forth above.

Accordingly, the operation of the improved latch with a removable lock of the present application can now be set forth. In the locked position as shown in FIG. 3, the finger 48 extends from the handle 10 and engages the escutcheon 50 in the manner described above to lock the handle 10 against rotation and operation of the latch mechanism to unlatch the door. In a manner similar to that described above, the lock 16 is maintained in a locked position by the bolt 52 which extends from the barrel 44 into the forward pocket 90 to have its end contiguous to the top surface 68 of the insert 64. The coil spring 28 urges the lock 16 such that the bolt 52 bears against and is retained by the partition 70. It is to be noted that the bolt 52 differs from that previously described above in that the end which extends from the barrel 44 is squared off as opposed to beveled since sliding the bolt along surfaces within the receptacle is not contemplated. Additionally, the bolt 52 of the invention herein set forth is somewhat shorter than the bolt described above.

To unlock the handle 10 for rotation and operation of the latch mechanism to unlatch the door, the key is inserted into the tumbler mechanism freeing the tumbler mechanism 60 for rotation within the barrel 44. Rotation of the tumbler mechanism 60 displaces the lock pin 62 to retract the bolt 52 from a maintaining position into a changing position from the forward pocket 90 into the barrel 44 as substantially shown in FIG. 4. Once the bolt 52 has cleared the partition 70, the coil spring 28 urges the lock 16 rearwardly retracting the finger 48 from the escutcheon 50 to free the handle for rotation. The rearward movement of the lock 16 is halted when the retracted bolt 52, which still protrudes from the barrel 44, engages the second wall 86. To remove the key from the tumbler mechanism, the key is reversely rotated to its locked position which causes the bolt 52 to extend from the barrel 44 into the rear pocket 88 to lay contiguous to the upper shelf 84. In this position the key may be removed from the tumbler mechanism 60. As can be appreciated with the key withdrawn from the tumbler mechanism 60, the bolt 52 is retained in the pocket defined by the partition 70, upper shelf 84 and second wall 86 preventing the lock 16 from being displaced either rearwardly or forwardly to a locked position. Accordingly, the handle 10, and the attached latch mechanism, cannot be locked without first retracting the bolt 52 from the rear pocket 88 into the barrel 44 which requires insertion of the key into and rotation of the tumbler mechanism 60. This, in turn, prevents the key from being locked within the vehicle.

To lock the handle and latch mechanism, the door is closed and the handle is rotated to the latch mechanism whereupon the handle 10 and escutcheon 50 are orientated for registration between the escutcheon 50 and the finger 48. The key is inserted in the tumbler mechanism which is rotated within the barrel 44 retracting the bolt 52 which clears the partition 70 permitting the lock 16 to be axially displaced to the locked position shown in FIG. 3 wherein the finger engages the escutcheon 50 locking the handle 10 against rotation. Thereafter the key is reversely rotated to the locked position extending the bolt 52 into the forward pocket 90 and the key is withdrawn, the bolt resuming its position shown in FIG. 3 urged against the partition 70 by the coil spring 28.

To remove the lock 16 from the handle 10 for replacement thereof, the key is inserted into the tumbler mechanism 60 which is rotated to retract the bolt 52 to its retracted position substantially shown in FIG. 4. Thereafter the lock 16 is pushed into the handle 10 (to the left in FIG. 4) such that the bolt 52 is aligned with the cam surface 63. Grasping the keyway end of the barrel 44 with a tong-like tool and rotating the lock 16 within the lock receptacle 18 causes the bolt 52 to follow the cam surface 63 as shown in FIG. 2, completely retracting the bolt 52 into the barrel 44. Once the bolt 52 has been retracted, in the foregoing manner, the lock 16 is freed from and is urged from the handle 10 by the coil spring 28.

To replace the lock 16 into the handle, the key is rotated to retract the bolt 52. Complete retraction of the bolt 52 against the bolt spring 56 is effected by pushing the bolt 52 inward with a finger. Holding the bolt 52 retracted, the lock 16 is inserted into the lock receptacle 18 and pushed forwardly such that the bolt 52 extends downward past the second wall 86. Thereafter the lock 16 functions as described above.

While we have shown and described a certain embodiment of this invention, it is to be understood that it is capable of many modifications without departing from the spirit and scope of the invention as disclosed in the attached claims.

We claim:

1. In a locking device having a barrel axially movable between a locking position and an unlocking position, said barrel having a key-operated bolt reciprocable between an extended position and a retracted position, the improvement comprising:

an insert receivable within a chamber in the device, said chamber having a shoulder separating two steps therein, said insert abutting said chambe shoulder with a tongue received within a groove in the chamber shoulder and including a partition defining first and second pockets on either side thereof to receive the bolt when in its extended positions to maintain the barrel in either its locking position or unlocking position respectively, whereby said bolt in its retracted position is clear of said partition.

2. The improvement of claim 1, further comprising an upstanding shoulder on the insert, and a plate secured to said device and engaging said insert shoulder to fix the insert in the chamber.

3. A lock for a latch member, comprising:

a lock barrel received within a receptacle in the latch member and axially reciprocable therein between a locking position and an unlocking position;

a bolt receprocable in the barrel between a lock changing position and a lock maintaining position;

a key-operated lock plug pivotable within the barrel to reciprocate the bolt;

a stepped chamber in the latch member having a shoulder between steps, said shoulder facing forwardly with a groove therein;

an insert at its rearward end abutting the shoulder with a rearwardly projecting tongue received in the shoulder groove, said insert further including an upstanding partition engageable with the bolt when in its lock maintaining postion to maintain the lock barrel in its locking or unlocking position, said partition being clear of the bolt when the bolt is in its lock changing position; and means engaging a forwardly facing portion of the insert for maintaining the insert within the chamber.

4. The lock of claim 3, further comprising an upstanding shoulder with a forward face on the insert, wherein the maintaining means is a plate secured to the latch member and engaging the shoulder face.

5. In a door latch of the type having a handle movable to latch and unlatch the door, a lock disposed in said handle, said lock movable to a locked position to extend from said handle to said door to lock said handle in a latched position, said lock having a bolt extending from a side of the lock to maintain the lock in said locked position, said bolt being retracted into said lock by insertion and rotation of a key in said lock to permit said lock to be withdrawn into said handle from said door to an unlocked position wherein said handle is movable to unlatch the door, the improvement comprising:

a stepped chamber within the handle, said stepped chamber being defined by a lower shelf extending rearwardly away from the face of the handle nearest said door, a first wall upstanding from said lower shelf, an upper shelf extending rearwardly from said first wall, and a second wall upstanding from said upper shelf; and a planar insert disposed along said lower shelf and having an upstanding partition abutting said first wall and defining a first pocket to receive said bolt when extended to maintain said lock in the locked position and a second pocket to receive said bolt when extended to maintain said lock in the unlocked position, said bolt being retractable to clear said partition to permit movement of said lock between said locked and unlocked positions, said insert further including an upstanding shoulder adapted to be engaged by a plate secured to said handle face nearest the door to retain said insert in said chamber.

* * * * *